United States Patent [19]

Mulcahy

[11] 4,413,569

[45] Nov. 8, 1983

[54] STEERING RAILROAD TRUCK

[75] Inventor: Harry W. Mulcahy, Griffith, Ind.

[73] Assignee: AMSTED Industries Incorporated, Chicago, Ill.

[21] Appl. No.: 261,421

[22] Filed: May 7, 1981

Related U.S. Application Data

[63] Continuation of Ser. No. 53,934, Jul. 2, 1979, abandoned, which is a continuation-in-part of Ser. No. 903,952, May 8, 1978, abandoned.

[51] Int. Cl.[3] ..... B61B 5/38; B61B 5/44; B61H 13/00

[52] U.S. Cl. ..... 105/168; 105/182 R; 105/224 R; 105/224.1; 188/52

[58] Field of Search ..... 105/165, 167, 168, 169, 105/176, 182 R, 199 R, 200, 207, 224.1, 224 R; 188/52

[56] References Cited

U.S. PATENT DOCUMENTS

| | | | |
|---|---|---|---|
| 243,797 | 7/1881 | Robinson | 105/168 |
| 243,798 | 7/1881 | Robinson | 105/168 |
| 2,042,623 | 6/1936 | Montrose-Oster | 105/169 |
| 2,296,106 | 9/1942 | Holland et al. | 105/167 |
| 2,852,248 | 9/1958 | Travilla et al. | 105/200 X |
| 3,528,374 | 9/1970 | Wickens | 105/168 X |
| 3,785,298 | 6/1974 | Reynolds | 105/224.1 X |
| 3,789,770 | 2/1974 | List | 105/168 |
| 4,003,316 | 1/1977 | Monselle | 105/167 |
| 4,067,261 | 1/1978 | Scheffel | 105/167 |
| 4,067,262 | 1/1978 | Scheffel | 105/182 R X |
| 4,114,540 | 9/1978 | Strugielski et al. | 105/226 |
| 4,131,060 | 12/1978 | List | 105/182 R X |
| 4,147,237 | 4/1979 | Mulcahy | 188/52 |
| 4,167,907 | 9/1979 | Mulcahy et al. | 105/207 X |

FOREIGN PATENT DOCUMENTS

| | | | |
|---|---|---|---|
| 22211 | of 1909 | United Kingdom | 105/176 |
| 1179723 | 1/1970 | United Kingdom | 105/165 |

OTHER PUBLICATIONS

Proceeding of the Institute of Mechanical Engineers 1969–1970; Paper No. 3; Suspension Design for High-Performance Two-Axle Freight Vehicles; A. H. Wickens, A. D. Gilchrist; and A. E. W. Hobbs.

ASME Publication; 71-RR-1; An Evaluation of Recent Developments In Rail Truck Design; H. A. List.

*Primary Examiner*—Robert B. Reeves
*Assistant Examiner*—Howard Beltran
*Attorney, Agent, or Firm*—Edward J. Brosius; Fred P. Kostka

[57] ABSTRACT

A truck for a railroad car has a front and rear wheelset with axle ends rotatively carried in a front and rear steering arm, respectively. The steering arms are carried in pedestal jaws of a right and left side frame with resilient pads interfacing between the steering arms and the side frames. The resilient pads allow each wheelset and steering arm to rotate or yaw to an out-of-square condition with respect to the side frame as the railroad car proceeds, for example, around a curve in the track on which the car is traveling. This rotational movement is selectively regulated by a joint connecting the front and rear steering arms.

7 Claims, 13 Drawing Figures

STEERING RAILROAD TRUCK

This application is a continuation of co-pending application Ser. No. 053,934 filed July 2, 1979, which was a continuation-in-part of application Ser. No. 903,952 filed May 8, 1978, both of which are now abandoned.

BACKGROUND OF THE INVENTION

1. Field of the Invention

This invention relates to a truck for use with railroad cars and particularly to a truck which allows relative yawing movement between a wheelset of the truck and side frames of the truck as the railroad car proceeds, for example, around a curve in a section of track on which the railroad car is traveling.

2. Prior Art

Today most all railroad car trucks in use include spaced side frames resiliently supporting therebetween a transversely positioned bolster. The bolster contains a centerplate which in turn supports a body of the railroad car. The side frames have downward projecting jaws in which axle ends of a front and rear wheelset are rotatively journaled. Such trucks may be referred to as nonsteerable trucks.

Steerable trucks are ones having wheelsets which may yaw. Such trucks are well known and one typical type is disclosed in U.S. Pat. No. 3,789,770. As disclosed, this truck allows rotation of each wheelset about its vertical axis so that the wheelset may take an out-of-square position with respect to a longitudinal axis of the truck. The wheelsets are joined by positive mechanical linkage which controls and maintains the relationship between the wheelsets. Additionally, this linkage is connected to a body of the railroad car so that movement between the car body and the wheelsets is maintained in a fixed relationship.

Providing a flexible connection between the axle ends of the wheelset and the side frame to allow yawing therebetween is also well known and is disclosed in, for example, U.S. Pat. No. 3,785,298. In this case, a resilient or elastomeric device interfaces between pedestal jaws of a side frame of the truck and axle ends of the wheelsets to allow limited movement therebetween which is restrained by the elastomeric device.

U.S. Pat. No. 3,528,374 discloses a truck which is perhaps the first to adapt the steering principle to a modern day truck. In this instance, a bolster has its ends resiliently carried by side frames. Ends of the side frames are adapted to allow the wheelsets of the truck to yaw. Yawing in turn is regulated by parallel elastic bracing members connecting aligned front and rear axle ends and diagonally positioned elastic bracing members connecting opposite front and rear axle ends.

A further arrangement to provide a truck with wheelsets which can yaw so as to maintain an aligned relationship with the track on which the truck is traveling is disclosed by U.S. Pat. No. 4,003,316. As so disclosed, holding frames which carry the axle ends of the wheelsets are individually connected to a bolster of the truck through a ball bearing socket arrangement enclosed in a pad. Any lateral movement of the bolster effects a rotational movement of the holding frame and thus the wheelsets.

Most recent development in steerable trucks is perhaps disclosed in U.S. Pat. Nos. 4,067,261 and 4,131,069. The disclosure of the first patent places particular emphasis on the use of wheels having highly profiled wheel treads to generate steering forces. A pair of U-shaped subframes carries the axle ends of each wheelset and may be interconnected by a pair of diagonally positioned rods. These rods may be interconnected through a dampening means.

The U.S. Pat. No. 4,131,069 discloses a further steerable railroad car truck wherein resilient means of predetermined stiffness interconnects the axle ends carrying subframes of the truck at a centrally located point. Additionally, resilient means interconnect the subframes with the side frames of the truck and the truck with a body of the car.

SUMMARY OF THE INVENTION

A railroad truck of this invention includes a pair of spaced side frames each having a front and rear downward projecting pedestal jaw. Resiliently supported by the pair of side frames at midpoints thereof are ends of a transversely positioned bolster which in turn support thereabove a body of a railroad car.

Within the front pedestal jaws of the side frames are side portions of a U-shaped front steering arm while a like rear steering arm has its side portions positioned within the rear jaws of the two side frames. Interfacing between a top surface of the side portions of each steering arm and a bottom surface of each pedestal jaw of the side frames is an elastomeric device.

Each wheelset of the truck has its axle ends rotatively journaled in bearings carried in the side portions of each steering arm. The elastomeric devices allow the steering arms and connected wheelsets to yaw or rotate about the vertical axis of the wheelset. When such rotation or yawing occurs, the wheelsets of the truck and steering arms move to an out-of-square position with respect to a longitudinal axis of the truck.

Protruding inwardly from a middle part of each steering arm is a bracket which is positioned parallel to the longitudinal axis of the truck and located within a center cavity specifically provided for such in the truck bolster. Inner ends of the brackets form part of a joint or connection with a plurality of spherical washers and a fastener. The joint provides a regulation of the wheelset movement to an out-of-square position which may proximate 1.8 degrees. During such movement to this out-of-square position, the joint remains independent of the bolster in that the center cavity provides a clear passage therethrough. Once in an out-of-square position, the joint provides only a negligible restoring force.

The truck of this invention has several important advantages over both nonsteerable trucks and steerable trucks presently known.

Firstly, the truck of this invention provides means allowing individual wheelsets to more perfectly react to curvature in the track on which the railroad car is traveling. For example, when the truck encounters a left-hand curve in the track, the forwardmost or front wheelset will tend to rotate counterclockwise about its vertical axis while the rear wheelset will tend to likewise rotate counterclockwise about its vertical axis. This rotational tendency is created by the configuration of the outer surfaces of the wheels. Nonsteerable trucks inhibit such rotation. Known steerable trucks allow such rotation which until now was controlled by some resilient device or by positive mechanical linkage connecting the front and rear wheelsets.

In nonsteerable trucks, wear of the wheelsets is not minimized since a certain amount of slippage between the wheelset and the track is required to traverse a curve. In known steerable trucks controlled by resilient devices, increased yawing produces a likewise increased restoring force.

A further advantage of the truck of this invention is the recognition that to minimize wheelset wear, each wheelset must be allowed a certain amount of independent vertical movement with respect to each other wheelset to accommodate variations in the vertical height of the track. Such variations occur, for example, between track elements particularly at joints therebetween where there has been rail wear adjacent the joint.

By providing for horizontal rotation of proximately 2 degrees, a certain amount of independent vertical movement, and selectively controlling these movements by the use of the elastomeric pads and the joint between the steering arms, wheelset wear is reduced and the truck provides improved stability by regulation of the various dynamic forces created during travel.

DESCRIPTION OF THE PREFERRED EMBODIMENT

Figure 1:
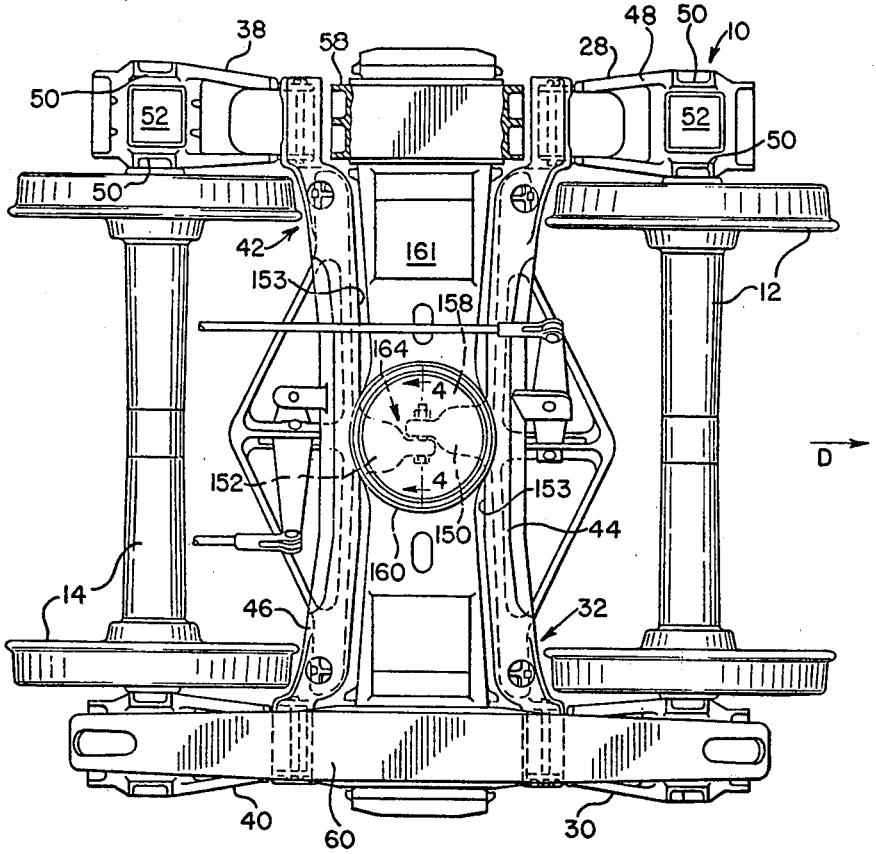
FIG. 1 is a plan view of the truck of this invention with a partial section through one side frame of the truck.
Figure 2:
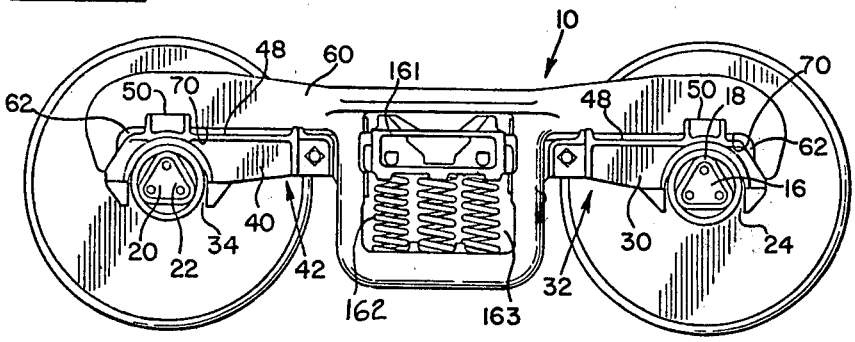
FIG. 2 is an elevational view of the truck of FIG. 1.
Figure 3:
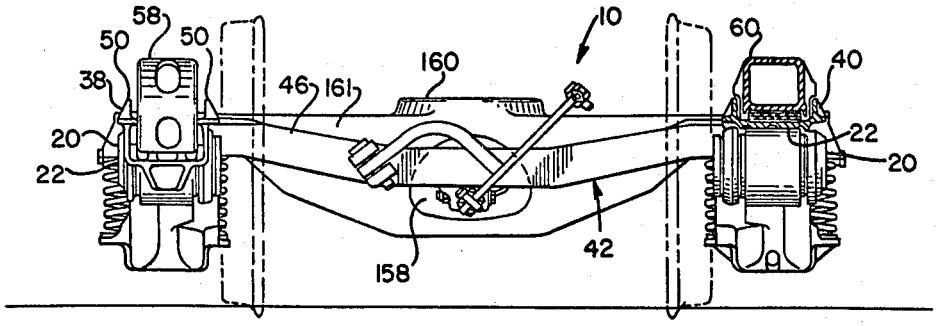
FIG. 3 is an offset elevational section view in partial cross section of an embodiment of the truck of this invention.

A truck of this invention is shown generally at 10 and includes a front wheelset 12 and a rear wheelset 14. The front wheelset 12 has axle ends 16 journaled in front wheel bearings 18 while in a like manner the rear wheelset 14 has axle ends 20 journaled in rear wheel bearings 22. It should be understood that the truck 10 is nondirectional and "front" and "rear" are used to more conveniently describe the embodiment.

To secure the position of the front wheelset 12, the front wheel bearings 18 are carried in a downward projecting semi-circular opening 24 formed in a left and a right side portion 28, 30 of a U-shaped front steering arm 32. In a like manner, the rear wheel bearings 22 associated with the rear wheelset 14 are carried in a like downward projecting semi-circular opening 34 formed in a left and a right side portion 38, 40 of a rear U-shaped steering arm 42. The rear steering arm 42 is positioned in an opposing manner with respect to the front steering arm 32 so that a middle part 44 of the front steering arm 32 is opposite a middle part 46 of the rear steering arm 42.

On a top surface 48 of each left and right side portion 28, 30 and 38, 40 of the front and rear steering arms 32 and 42 are upwardly projecting spaced flanges 50 positioned on each side of a rectangular recess 52 containing an elastomeric pad 54. The pad 54 has a rectangular configuration to form a snug fit within the recess 52. The recess 52 has a depth proximating $\frac{1}{4}$ of a thickness of the pads 54 so that a top surface 56 of each pad 54 extends above the top surface 48 of the side portions 28 and 30 of the front steering arm 32 and of the side portions 38, 40 of the rear steering arm 42.

The truck 10 further includes a left and a right side fame 58, 60 formed having a front and rear downwardly projecting pedestal jaw 62 at each end of the side frames 58, 60.

Each pedestal jaw 62 has a roof surface 70 with downwardly projecting spaced flanges 72 defining in part a rectangular-shaped covering area 74 for the pads 54. Each area 74 has the same proximate size as each recess 52 of the front and rear steering arms 32 and 42. The height of the flanges 72 proximates $\frac{1}{2}$ the thickness of the pad 54 so that a space 76 is formed between the flanges 72 of the pedestal jaws 62 and the top surface 48 of each side portion 28, 30 and 38, 40 when the left and right side frames 58 and 60 are assembled to and supported on the pads 54 respectively.

The front and rear steering arms 32, 42 each have a bracket 150 and 152 formed on a side 153 of each middle part 44 and 46 of the front and rear steering arms 32, 42 respectively. These brackets 150 and 152 are opposing and offset from a center point of the respective arms 32, 42 so that apertures 154, 156 formed respectively in each bracket 150, 152 at its outer end are horizontally aligned as each bracket 150 and 152 extends into a center cavity 158 formed beneath a centerplate 160 of a transversely positioned bolster 161. The bolster 161 in turn has its ends resiliently carried by a set of springs 162 in a window 163 formed in each side frame 58, 60.

The front and rear brackets 150 and 152 form part of a joint 164 which further includes four sets of spherical washers 166, 168, 170 and 172. Each set of washers further comprises one element having a flat outer surface and an inner convex spherical surface which mates with a second element having an inner concave spherical surface and a flat outer surface. In the exemplary embodiment, the convex element has an "a" suffix while the concave element has a "b" suffix so that, for example, the washer set 166 has a convex element **166*a* and a concave element 166*b*. A radius of curvature of the interfacing spherical surfaces of the washers sets 166–172 has been so selected to complement the rotational movement of the steering arms 32, 42**.

About each aperture 154 and 156 on each side of the front and rear brackets 150, 152 are circular recesses 174, 176, 178 and 180 in which the washer sets 166, 168, 170 and 172 are respectively disposed. Note that each convex element **166*a*, 168*a*, 170*a* and 172*a* is oriented toward the center of the joint 164. The connection 164 further includes a bolt 182 inserted through the washer sets 166–172 and the apertures 154 and 156 of the front and rear brackets 150, 152 and held therein by a self-locking nut 184. The bolt 182 and nut 184 are so assembled as to apply a slight compressive force to the various joint elements when each wheelset 12, 14 and each steering arm 32, 42** is in a squared relationship with respect to the longitudinal axis of the truck.

During travel of the truck 10 over a straight section of track, each wheelset 12, 14 tracks in a straight line path adjusting automatically for variations in track width and deviation from a straight line path. This automatic correction results from an interaction of the wheel tread with the track. Additionally, other deviations are regulated by a flexing of elastomeric pads 54 and the joint 164. This regulation also helps to control hunting of the wheelsets 12, 14 and lozenging of the side frames 58, 60.

During such straight line travel in a direction as shown by an arrow D in FIG. 1, some rolling of the wheelsets 12, 14, i.e. longitudinal rotation of the wheelsets about the longitudinal axis of the truck 10, occurs because of vertical difference in track height. As was noted earlier, such height differences particularly exist adjacent abutting track ends. This rolling movement of each wheelset is transferred to the front and rear steering arms 32, 42 and regulated by the elastomeric pads 54 and the joint 164 where vertical movement between the spherical elements of the washer sets 166–172 may occur.

Upon first encountering a curved section of track, for example a left-hand curve, the front wheelset 12 of the truck 10 tracks about the curve and thus rotates or yaws counterclockwise about its vertical axis. This rotational movement is transferred to the front steering arm 32 causing a flexing of the front set of elastomeric pads 54 and horizontal movement between the spherical elements of the washer sets 166–172. Note that if the curved section is also banked to allow a higher speed of travel thereabout, there is likewise some rolling rotation of the front wheelset 12 and vertical movement between the spherical elements of the washer sets 166–172.

Figure 4:
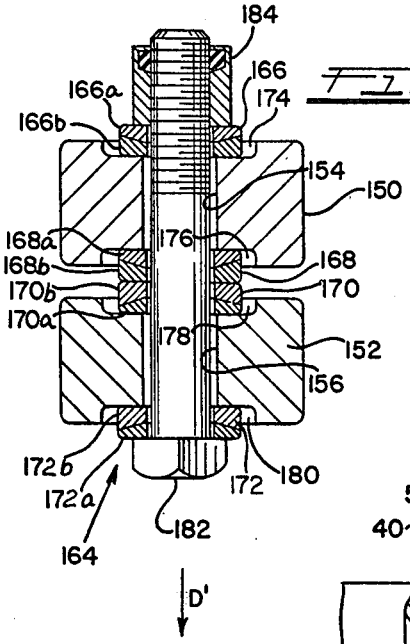
FIG. 4 is a cross-sectional view, which has been rotated 90 degrees, of a connecting joint formed between two steering arms as shown along the line 4—4 of FIG. 1.
Figure 5:
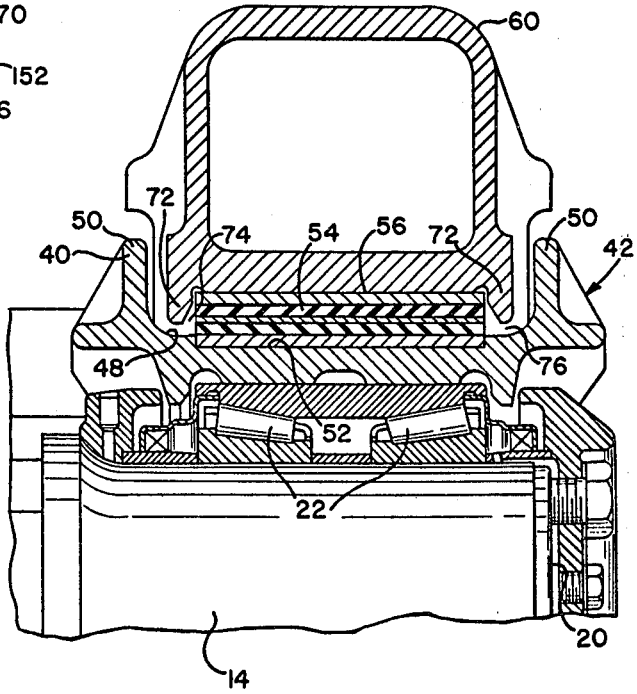
FIG. 5 is a detailed sectional view of the side frame-steering arm-wheelset assembly shown in FIG. 3.
Figure 6:
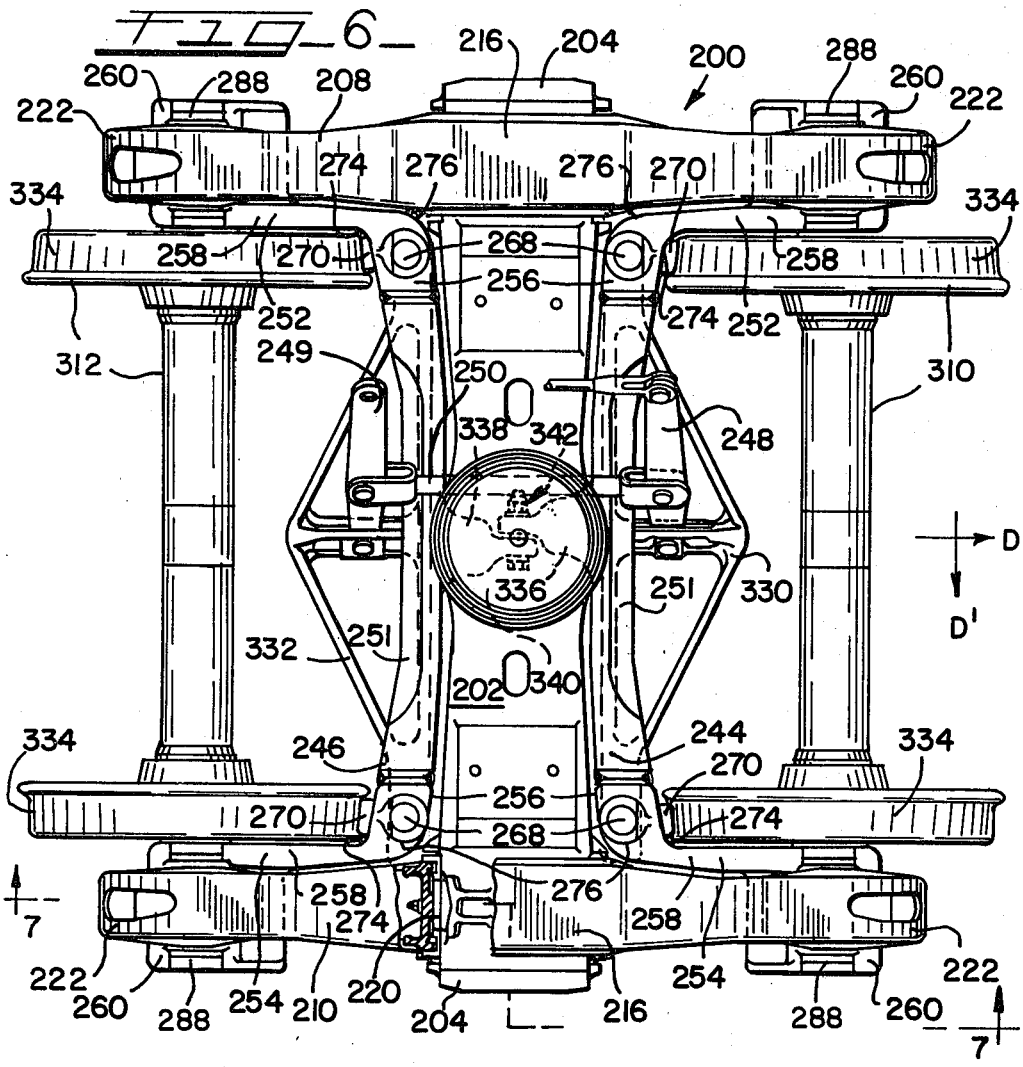
FIG. 6 is a plan view of a further embodiment of the truck of this invention.
Figure 7:
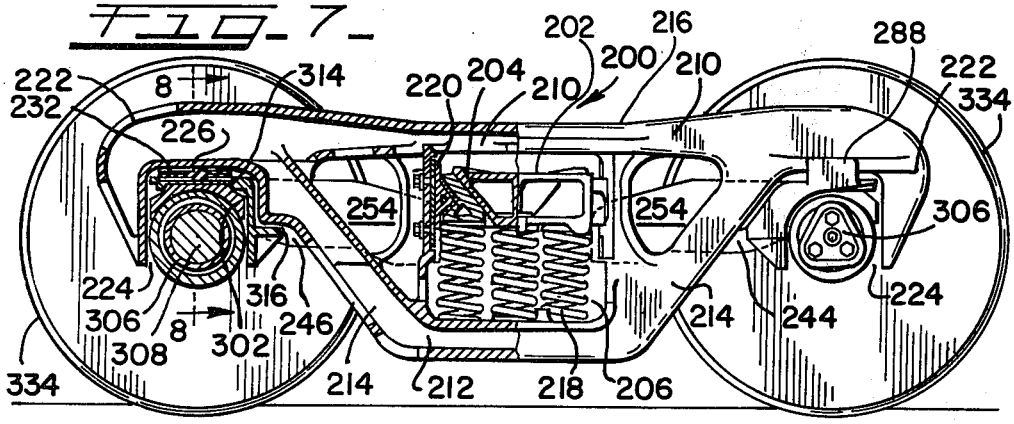
FIG. 7 is a side elevational view in partial section of the truck of FIG. 6 as seen generally along the line 7—7 of FIG. 6.

As the front wheelset 12 and the front steering arm 32 continue to rotate counterclockwise, this rotational movement is transferred by the front steering arm bracket 150 to the rear steering arm bracket 152 and thus may cause the rear steering arm 42 and rear wheelset 14 to rotate clockwise. During this rotational movement of the front and the rear steering arm brackets 150, 152, the bolt 182 of the joint 164 moves in a straight line as noted by arrow D′ as seen in FIG. 4.

This rotation of the steering arm brackets 150, 152 moves the washer set elements 166*a,b*-172*a,b* to a non-aligning relationship such that the brackets 150, 152, through the washer sets 166–172, may apply some additional force on the bolt 182. This additional force on the bolt 182 helps to regulate the rotation of the steering arms 32, 42 and thus the front and rear wheelsets 12, 14. Note, however, that while the force on the bolt 182 regulates movement from a squared position to a non-squared position, the bolt 182 only exerts a negligible restoring force.

As the truck 10 leaves the curved section of track to return to another straight section, the front wheelset 12 tracks clockwise causing the front steering arm 32 and the attached bracket 150 to likewise rotate clockwise. This clockwise rotation is transferred by the brackets 150, 152 and the washer sets 166–172 causing a counterclockwise rotation of the rear steering arm 42 and rear wheelset 14. The joint 164 thus moves in a direction opposite the arrow D′ of FIG. 1.

As seen in FIGS. 6–10 is a second embodiment of this inventive railroad car truck which is designated 200. Like the truck 10, the truck 200 includes a transversely positioned bolster 202 having ends 204 resiliently carried in a window 206 formed in a left and right side frame 208, 210.

The side frames 208, 210 have a more conventional configuration in that the window 206 is defined by a bottom tension member 212 connecting with inclined members 214 to form a truss-like formation with a top compression member 216. The resilient support of the bolster 202 is provided by a set of springs 218 carried by each bottom tension member 212 of the left and right side frames 208, 210. This resilient support is further regulated by a snubbing device 220. One preferred embodiment of such a snubbing device is disclosed in copending application Ser. No. 844,965 filed Oct. 17, 1977 now U.S. Pat. No. 4,167,907, issued Sept. 18, 1979.

At outer ends 222 of each side frame 208, 210 is a downward facing pedestal jaw 224. Each pedestal jaw 224 has a flat roof or top surface 226 and a pair of downwardly extending spaced flanges 228 to define a covering area 230 having a rectangular configuration. Disposed in each covering area 230 is an elastomeric device 232. Like the truck 10, the truck 200 has four such devices 232.

Each elastomeric device 232 comprises an upper, middle and lower plate 234, 236, 238 integrally joined to an elastomeric material 240 which maintains the plates 234, 236, 238 in a spaced relationship. To facilitate forming this device into an integral unit, an aperture 242 is provided in each plate 234, 236, 238 to allow the elastomeric material 240 to be injection molded therebetween. Note that the upper plate 234 of each device 232 interfaces directly with the respective pedestal jaw covering area 230.

The lower plates 238 of the front elastomeric devices 232 are supported by a front steering arm 244 while the lower plates 232 of the rear elastomeric devices 232 are supported by a rear arm 246. The arms 244, 246 are substantially identical and therefore only the rear arm 246 will be described in detail. Note that arms 244, 246 are different from the arms 32, 42 of the first embodiment 10, however.

Figure 8:
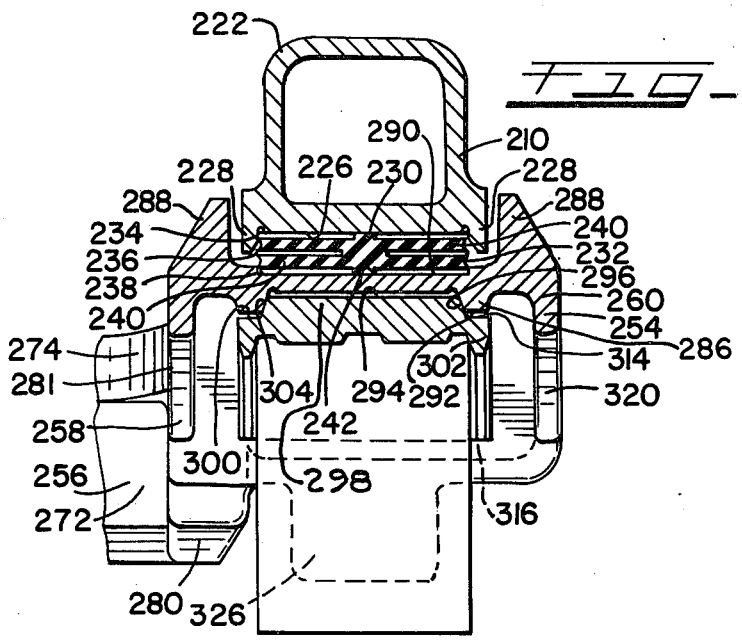
FIG. 8 is a partial cross-sectional view as seen generally along the line 8—8 of FIG. 7.
Figure 10:
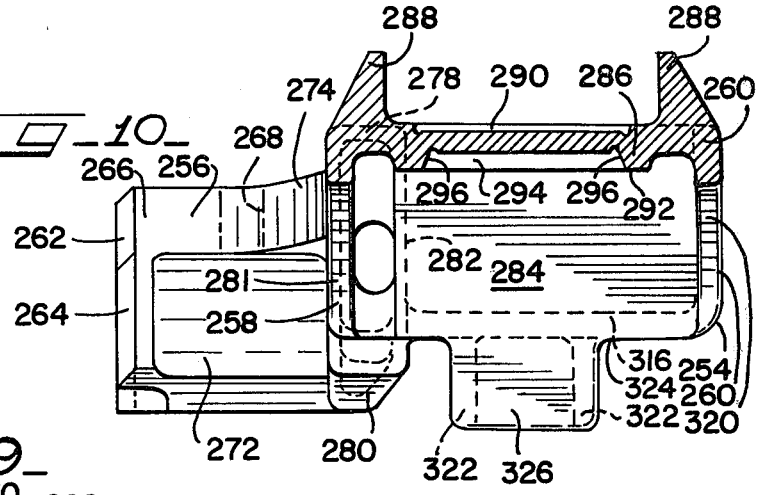
FIG. 10 is a cross-sectional view as seen generally along the line 10—10 of FIG. 9.
Figure 9:
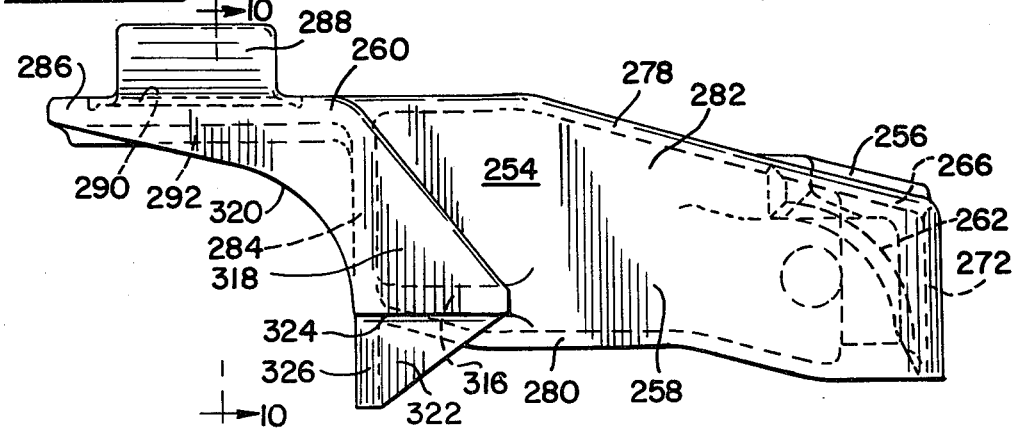
FIG. 9 is a side elevational view in detail of a side portion of a steering arm used in the truck of FIG. 6.

Each steering arm 244, 246 comprises an elongated middle part 251 having ends weldedly joined to a left and right side portion 252, 254. The side portions 252, 254 are identical except formed on an opposite hand. As shown in FIGS. 8, 9 and 10 is the right side portion 254 of the rear steering arm 246 which will be described in detail. The right side portion 254 has an offset configuration comprising an inwardly extending part 256, a longitudinal leg extension 258 and an outwardly extending part 260.

The inwardly extending part 256 has a C-shaped end wall 262 with chamfered edges 264 to facilitate joinder by welding to the elongated middle part 251 of the steering arm 246. Between the end wall 262 and the leg extension 258, the inwardly extending part 256 has an inverted L-shaped configuration which includes a top horizontal leg 266 with a vertical aperture 268 therethrough to provide access to one of four brake shoes 270 therebelow. The top leg 266 of the inwardly extending portion 256 and a vertical leg 272 of such join a front end of the longitudinal leg extension 258 to form inner and outer radius corners 274, 276.

The extension leg 258 has a thin hollow configuration which includes a top and a bottom wall 278, 280 which angles upwardly to join the outwardly extending part 260. Joining a rear end of inner and outer sidewalls 281, 282 of the leg extension 258 is a transversely positioned vertical partition 284 of the outwardly extending part 260. A top horizontal member 286 extends rearwardly from a top edge of the vertical partition 284. Along the outer top edges of the horizontal member 286 are upwardly projecting wedge-shaped flanges 288 which lie along a rectangular receiving area 290 for the elastomeric devices 232. As seen in FIG. 8, the outer end 222 of the right side frame 210 rests on the elastomeric device 232 and between the two flanges 288.

On a bottom side 292 of the horizontal member 286 is a circular-shaped recess 294 having an upwardly and inwardly converging circular sidewall 296. Disposed in the circular recess 294 is an annular boss 298 formed on the upper side 300 of a bearing adapter 302. The adapter annular boss 298 has an inwardly converging sidewall 304 to fit in a complementary manner with the sidewall 296 of the recess 294.

Each adapter 302 in turn fits over a bearing 306 in which axle ends 308 of a front and a rear wheelset 310, 312. Because the bolster 202 transfers the load of the railroad car body thereabove (not shown) to the wheelsets 310, 312 through the side frames 208, 210, the elastomeric devices 232 to the steering arms 244, 246, the interaction between each adapter boss 298 and respective steering arm outwardly extending portion recess 294 forms a compressive joint 314. These joints 314 become readily releaseable upon removal of the load. Additionally the joint 314 provides limited movement between the adapter 302 and each steering arm 244, 246 to provide a more perfect operational fit between such. Under this arrangement, the wheelsets and respective steering arms are formed into a unit.

To provide additional stiffness to the steering arm outwardly extending part 260, the vertical partition 284 extends below the bottom wall 280 of the leg extension 258 and is further joined to such by a horizontal web 316 which projects outwardly from the outer leg extension sidewall 282 and joins an outer sidewall 318 which also connects with the top horizontal member 286, the vertical partition 284 and an outer end of the horizontal web 316. The outer sidewall 318 has a downwardly curved shaped lower edge 320 which tangentially joins the vertical partition 284 at a point proximately aligned with the horizontal web 316 where it terminates. The vertical partition 284 is further stiffened by a pair of spaced gussets 322 which are integrally joined to a bottom side 324 of the web 316 and to a tab 326 extending downwardly from the vertical partition 384.

One preferred form of brake rigging for a steerable truck is disclosed in U.S. Pat. No. 4,147,237. Another preferred brake rigging arrangement, which is more conventional in nature and shown in FIG. 6, includes a front and rear brake beam 330, 332 which are each pivotally connected to a lower end of a front and rear brake lever 248, 249. A tie rod 250 proximately aligned with a longitudinal axis of the railroad car connects the two brake levers 248, 249 in a middle portion of each. An opposite or upper end of one brake lever, for example the rear brake lever 249, may be pivotally connected to the truck bolster 202 or even the body of the railroad car. An opposite or upper end of the other brake lever, i.e. the front brake lever 248, is then operatively connected to a source of power whereby the brake shoes 270 may be forced respectively against wheels 334 of each wheelset 310, 312.

Under this later brake rigging arrangement, upon activation, the front and rear wheelsets 306, 308 are forced apart in that the braking force is applied concurrently to the elastomeric devices 232. Under the braking arrangement described in U.S. Pat. No. 4,147,237, the brake force does not act on the elastomeric devices 232 since the brake levers are carried directly by the steering arms 32, 42 of the truck 10 as is also shown in FIG. 1.

Like the first embodiment, i.e. truck 10, the front and rear steering arms 244, 246 of the truck 200 each carries a bracket 336, 338 which extends from the middle portion 251 of each steering arm 244, 246. Each bracket 336, 338 projects into a center cavity 340 of the bolster 202. One preferred embodiment of such a bolster center cavity 340 is disclosed in U.S. Pat. No. 4,114,540 wherein the center cavity 340 provides a clear passage through the bolster 202 so that the brackets 336, 338 remain independent of the bolster 202.

Figure 11:
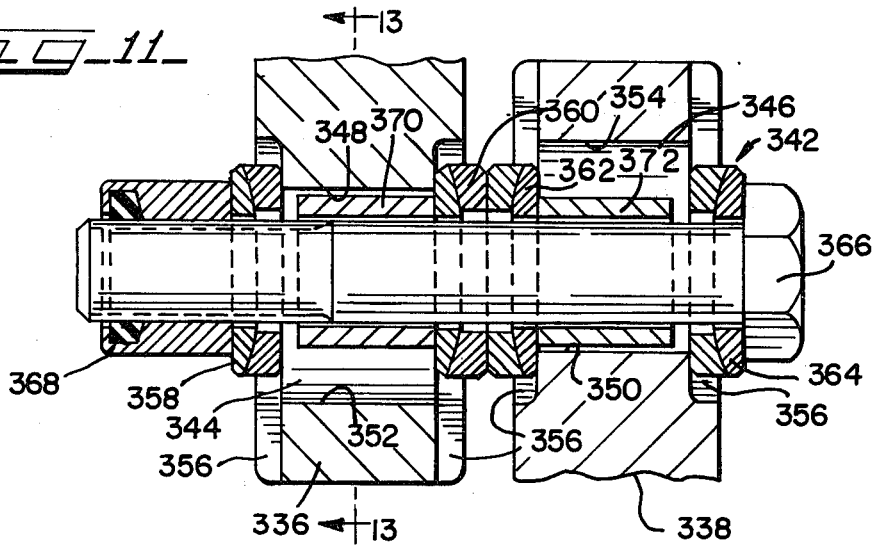
FIG. 11 is a cross-sectional view through a further embodiment of the joint between the steering arms.
Figure 12:
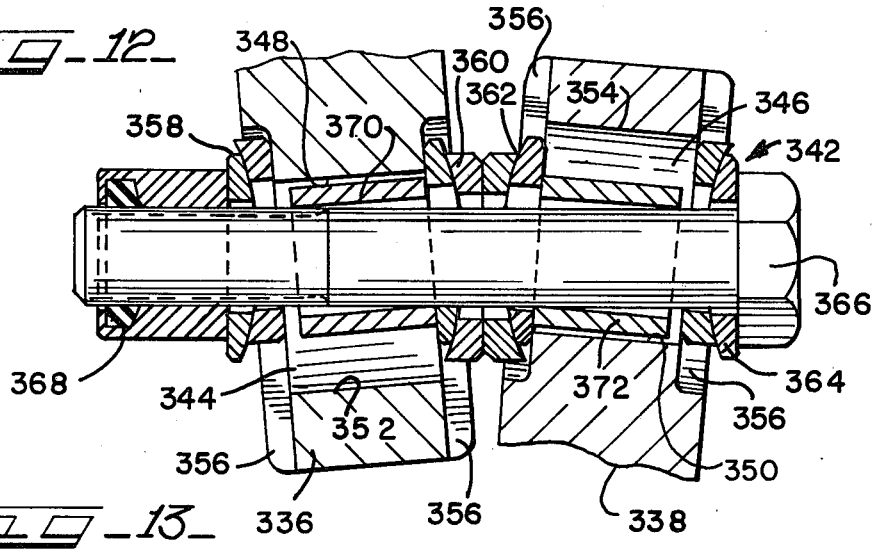
FIG. 12 is the joint of FIG. 11 wherein the arms have rotated to a nonaligning position.
Figure 13:
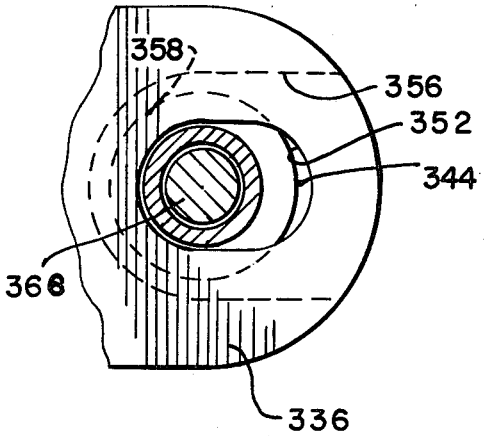
FIG. 13 is a cross-sectional view as seen generally along the line 13—13 of FIG. 11.

In the center cavity 340 the brackets 336, 338 are joined to form a movable joint 342 which may best be understood by viewing FIGS. 11–13. In an outer end of each bracket 336, 338 is an elongated aperture 344, 346. As shown by FIG. 11, when the brackets 336, 338 are positioned parallel, inner ends 348, 350 of each aperture 344, 346 are proximately aligned while outer ends 352, 354 are longitudinally offset. Surrounding each aperture 344, 346 on sides of each bracket 336, 338 is an elongated recess 356 which extends to an end of each bracket 336, 338. In each recess 358 is a set of spherical washers 358, 360, 362 and 364. These spherical washer sets 358–364 are similar to the washer sets 166–172 and thus need not be described again.

Extending through the apertures 344, 346 and the washer sets 358–364 is a retention bolt 366 secured therein by a lock nut 368. About the bolt 366 and in between the washer sets 358, 360 and 362, 364 are bushings 370, 372 which interact between the bolt 366 and the apertures 344, 346 and maintain the bolt 366 in proper alignment, for example, when the steering arms 344, 346 swing to an out-of-square position as seen in FIG. 12.

The truck 200 operates in substantially the same manner as truck 10. Because the wheels 334 have a conical-like profile, each wheelset 310, 312 attempts to center itself on the track on which it is traveling. Since the distance between rails is not constant nor the rails straight, the wheelsets 310, 312 continuously move transversely or laterally to the direction of movement as denoted by the arrow D′ in FIG. 6. Note that there is no independent lateral movement by either wheelset 310, 312 because of the joint 342 between the steering arms 244, 246. Some independent lateral movement may occur when the wheelsets 310, 312 swing to a non-aligned position. The joint 342 insures that such lateral movement of the wheelsets 310, 312 becomes joint after the independent movement exceeds certain nominal limits. By restricting independent lateral movement of the wheelsets 310, 312, improved wheel wear is obtained.

Additionally, as the truck 200 travels at a speed above a critical speed, each wheelset 310, 312 attempts to hunt or oscillate above its vertical axis. Note that when such hunting occurs, each wheelset 310, 312 attempts to move to an out-of-square position with respect to track over which the wheelsets 310, 312 are traveling. When these oscillations of the wheelsets 310, 312 tend to be in-phase, the joint 342 through the steering arms 244, 246 inhibits such movement.

When the truck 200 is subjected to a braking force such that the brake shoes 270 carried by the more conventional brake rigging described earlier engages the wheels 334, the wheelsets 310, 312 are forced apart. As was noted, the brake levers 248, 249 need not be attached to the steering arms 244, 246 as is suggested in U.S. Pat. No. 4,147,237. This longitudinal displacement is accommodated by a deflector in the elastomeric devices 232 wherein the upper and lower plates 234, 236 of each device 232 are longitudinally offset.

Because each steering arm 244, 246 and its respective wheelsets 310, 312 are longitudinally fixed into a unit by the engagement between the adapter boss 298 with the recess 294 of the steering arm outwardly extending portion 260, each steering arm 244, 246 must also move longitudinally with its respective wheelset 310, 312. This longitudinal movement is accommodated by the joint 342 wherein the bolt 366 and the washer sets 358–364 move toward an outer end 352, 354 of each elongated aperture 344, 346 and recess 356 in the steering arm bracket 336, 338, respectively.

During this relative longitudinal movement between the bolt 366 and the front and rear steering arms 244, 246, the bushings 370, 372 insure that the bolt 366 remains properly aligned.

When the brake force on the shoes 270 is deactivated, the elastomeric devices 232 return the wheelsets 310, 312 and respective steering arms 244, 246 to a normal position wherein the joint 342 appears as shown in FIG. 11. Note that even during the application of the brake force described above, the joint 242 allows the wheelsets 310, 312 to swing to an out-of-square position if the truck 200 encounters a curved section of track. This swing action was discussed in detail with respect to truck 10 and the truck 200 is comparable in operation.

While various modifications may be suggested by those versed in the art, it should be understood that I wish to embody within the scope of the patent warranted hereon all such modifications as reasonably and properly come within the scope of my contribution to the art.

What is claimed is:

1. A railroad car truck for carrying a body of a railroad car, said truck assembled from a pair of spaced side frames, a bolster transversely positioned between said side frames with end portions of said bolster resiliently carried in windows centrally located in said side frames respectively, a pair of steering arms located on each side of said bolster and between said side frames, each said steering arm having side portions positioned within pedestal jaws formed at ends of said side frames, said steering arms joined at a point proximate a center of said bolster to in part regulate movement of said arms by a connection including a bracket formed on each said steering arm and positioned in a side by side relationship with multi-directional pivot means interconnected therewith, and a pair of wheelsets each having axle ends journaled in bearings located within said steering arm side portions to form a respective unit comprising said wheelset and said steering arm, an improvement in said truck comprising, an adapter carried one each on an upper portion of each said bearing and having a frustum-like shaped boss formed on an upper side of said adapter, an outwardly extending part forming part of said steering arm side portion, said extending part having a horizontal member with a reverse frustum-like shaped recess on a bottom side of said horizontal member to receive said adapter boss and form a compressive joint therebetween, and a recessed receiving area in a top side of said horizontal member, an elastomeric device having a lower portion disposed with a snug fit in said horizontal member receiving area, and a recessed covering area formed in a roof of said side frame pedestal jaw for disposition with a snug fit of an upper portion of said elastomeric device, said elastomeric device spacing said steering arm-wheelset unit from said side frame to allow movement therebetween, wherein steering forces generated between said wheelsets and trackage over which said truck may travel result in movement of each said steering arm-wheelset unit, said movements being regulated by said elastomeric device and said connection between said steering arms.

2. A railroad car as defined by claim 1 and further characterized by said connection between said steering arms comprising, said bracket formed one each on a middle portion of each said steering arm, each said bracket projecting inwardly toward said bolster with apertures respectively formed in end portions of each said bracket being laterally offset and horizontally aligned upon said steering arm-wheelset units being positioned in a squared relationship, said multi-directional pivot means being washer sets each comprising elements having mating spherical-like surfaces to allow multi-directional movement between said elements, said sets positioned between and on each side of said steering arm brackets, and a fastening device disposed through said bracket apertures and said washer sets to maintain said brackets and washer sets in a joined relationship while allowing movement of each said unit.

3. A railroad car truck as defined by claim 2 and further characterized by, each said bracket aperture being horizontally elongated with an elongated recess formed in alignment with said aperture on each side of each said bracket, and a bushing located in each bracket aperture with said fastening device disposed through said bushings.

4. A railroad car truck as defined in claim 3 and further characterized as including brake rigging comprising, a pair of brake beams positioned one each beneath each said steering arm, each said brake beam carrying at ends thereof brake shoes to engage said wheelsets respectively, a pair of brake levers, one each of said levers having a lower end pivotally attached to a middle portion of said brake beams respectively, an upper end of one said lever attachable to said railroad car body and an upper end of said other lever attachable to a power source, and a tie rod pivotallyy joined to a middle portion of each said brake lever, wherein activation of said power source creates a braking force transferable by said brake rigging so that said brake shoes engage with said wheelsets to inhibit travel of said truck.

5. A railroad car truck as defined by claim 1 and further characterized by said steering arm side portion having a Z-like offset configuration comprising, an inwardly extending part having an end wall joinable to a middle portion of said steering arm, a longitudinal leg extension having one end joined to said inwardly extending part, and said outwardly extendin part jointed to an opposite end of said leg extension.

6. A railroad car truck comprising two side frames in a spaced relationship and an elongated bolster transversely positioned between said side frames, said bolster having ends resiliently carried in a window formed in said side frames respectively, a first and a second wheelset each having axle ends journaled in bearings located in pedestal jaws in both ends of said side frames, a first and a second steering arm positioned one each on each side of said bolster, each said steering arm having side portions operatively connected to said wheelsets through said bearings respectively, each said steering arm and respective wheelset forming a first and a second unit with movements of each said wheelset being selectively transmitted to said respective steering arm to provide concurrent movement between such, and elastomeric means positively joining said steering arm side portions to said side frames while allowing said units to move independent of said side frames with said movements being regulated by joint means connecting said steering arms, said joint means including brackets formed on each said steering arm and positioned in a side by side relationship with multi-directional pivot means interconnected therewith, the improvement in said truck comprising, adapter means disposed one each over said axle end bearings, each said adapter having a boss formed on an upper side of such, and each said side portion of said first and said second steering arms having an outwardly extending part defined in part by a horizontal member, said member having a recess formed in a bottom surface of such with said adapter boss receivable in said recess to form a self-aligning joint, said elastomeric means having a lower portion disposed in an horizontal member recess formed in an upper portion of said first and second steering arms, and a recessed covering area formed in a roof of said side frame pedestal jaw for disposition of an upper portion of said elastomeric device, said elastomeric device spacing said steering arm-wheelset unit from said side frame to allow movement therebetween.

7. A railroad car truck as defined by claim 6 and further characterized by each said steering arm side portion having an offset configuration and further including, an inwardly extending part having an end wall prepared to be readily connected to a middle portion of said steering arm, said end wall joined by an upper horizontal leg and a vertical leg with an aperture formed in said horizontal leg to provide access to brake rigging means carried by said truck therebelow, a longitudinal leg extension part positioned parallel and inside said side frame located adjacent thereto, said leg extension part comprising a top and a bottom wall joined by spaced inner and outer sidewalls, one end of said leg extension joined to said horizontal and vertical legs of said inwardly extending part and an opposite end joined to said outwardly extending part at a point above said joiner with said inwardly extending part, said outwardly extending part further comprising a vertical partition carried across said opposite end of said leg extension top wall, bottom wall and inner and outer sidewalls, said vertical partition having a top edge joined to said horizontal member, a horizontal web connecting said leg extension outer sidewall and said vertical partition, and a pair of spaced gussets connected to a bottom side of said web and to a tab extending downwardly from said vertical partition.

* * * * *